US006502613B2

(12) United States Patent
Suzuki

(10) Patent No.: US 6,502,613 B2
(45) Date of Patent: Jan. 7, 2003

(54) ADHESIVE TAPE PIECE STICKING DEVICE

(75) Inventor: Hiroshi Suzuki, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 47 days.

(21) Appl. No.: 09/796,533

(22) Filed: Mar. 2, 2001

(65) Prior Publication Data

US 2002/0092621 A1 Jul. 18, 2002

Related U.S. Application Data

(63) Continuation of application No. PCT/JP99/04619, filed on Aug. 26, 1999.

(30) Foreign Application Priority Data

Sep. 3, 1998 (JP) ..... 10-249612

(51) Int. Cl.[7] ..... B64H 21/00

(52) U.S. Cl. ..... 156/361; 156/502; 156/505; 156/541; 156/543; 156/157; 242/556.1

(58) Field of Search ..... 156/157, 361, 156/502, 504, 505, 540, 541, 543; 242/551, 552, 556.1

(56) References Cited

U.S. PATENT DOCUMENTS 4,840,694 A * 6/1989 Brookman et al. ..... 156/157
5,385,622 A 1/1995 Klingebiel
5,538,587 A 7/1996 Sakano et al.
6,422,282 B1 * 7/2002 Meinke ..... 156/157

FOREIGN PATENT DOCUMENTS

JP A940270 2/1997
WO WO0013997 3/2000

* cited by examiner

*Primary Examiner*—Mark A. Osele
(74) *Attorney, Agent, or Firm*—Birch, Stewart, Kolasch & Birch, LLP

(57) ABSTRACT

An adhesive tape piece sticking device (14) for sticking a double-coated adhesive tape piece to a cigarette paper (P) has a motor (52) for rotating a reel (32) that takes up a tape band (T) delivered from a tape roll (58). A guide block (66) for projectingly guiding the tape band toward the paper (P) and a lift guide unit (68) are arranged in the middle of a take-up path for the tape band. The sticking device slides as a whole with a tape piece positioned between an edge (70) and a guide plate (74), thereby pressing the tape piece against the paper. Further, the lift guide unit is lowered to separate the mount from the tape piece that is stuck to the paper.

9 Claims, 9 Drawing Sheets

ADHESIVE TAPE PIECE STICKING DEVICE

This application is a continuation of PCT/JP99/04619, filed Aug. 26, 1999.

TECHNICAL FIELD

The present invention relates to a sticking device for sticking a double-coated adhesive tape piece, which is used to connect webs, to one of the webs.

BACKGROUND ART

In a cigarette manufacturing machine, cut tobacco is wrapped up in a paper that is supplied from a paper supply device, whereby a cigarette rod is formed. Accordingly, the paper must be supplied continuously lest this wrapping operation be interrupted. Normally, therefore, the paper supply device is furnished with two reels such that, when the working paper remaining on one reel is scarce, a new paper delivered from the other can be connected to the working paper. Generally, in this paper connection, the leading end of the new paper and the trailing end of the working paper are connected by means of a double-coated adhesive tape piece that is previously stuck to the leading end of the new paper.

In the manufacture of filter cigarettes in which filters attached to cigarettes by means of tip papers, the tip papers may be connected to one another by means of double-coated adhesive tape pieces to facilitate continuous supply of the tip papers, in some cases.

Conventionally, a device described in Jpn. Pat. Appln. KOKAI Publication No. 9-40270 is used to stick double-coated adhesive tape pieces to webs, such as papers, tip papers, etc. This adhesive tape supply device comprises a guide mechanism for guiding an adhesive tape band (hereinafter referred to as tape band) so that one of double-coated adhesive tape pieces on a mount of the tape band faces a web, and a push mechanism for moving a push member opposed to the web toward the web. The double-coated adhesive tape piece is pressed against the web to be stuck to it by means of the push member.

According to this adhesive tape supply device, the entire tape piece is pressed against the web by means of the push member in sticking the tape piece to the web, so that the possibility of the web being dislocated from a given position or wrinkled is lowered. Thus, the aforesaid adhesive tape supply device has an advantage in being able to stick tape pieces to highly flexible thin webs, such as papers, tip papers.

In sticking a double-coated adhesive tape piece of an adhesive tape band to a highly flexible thin web by means of this adhesive tape supply device, however, the adhesive tape band sometimes cannot be smoothly separated from the web after the tape piece is stuck. In this case, the web cannot be transported from a tape piece sticking position to a web connecting position, so that continuous supply of the web is retarded.

DISCLOSURE OF THE INVENTION

The object of the present invention is to provide a sticking device capable of securely sticking one of double-coated adhesive tape pieces on a mount of an adhesive tape band to a web and securely separating the adhesive tape band from the web.

In order to achieve the above object, according to the present invention, there is provided an adhesive tape piece sticking device that sticks a double-coated adhesive tape piece to a web in a web path section defined by a guide element and constituting a part of a web path.

The adhesive tape piece sticking device according to the present invention comprises: a delivery section for delivering an adhesive tape band composed of a mount and a plurality of double-coated adhesive tape pieces provided thereon; a guide section including first and second guide units arranged for relative movement toward and away from each other along the web path section and for relative movement relative to the guide element in a direction across the web path section, said first and second guide units serving to guide the adhesive tape band from the mount side thereof and form a projecting region with a variable region length in an adhesive tape band path, said projecting region projecting toward the web path section in the direction across the web path section, extending along the web path section, and permitting one of the double-coated adhesive tape pieces to be positioned in said projecting region; a first drive section for relatively moving the first and second guide units and the guide element toward and away from one another in the direction across the web path section; and a second drive section for relatively moving the first and second guide units toward and away from each other along the web path section.

According to the sticking device of the present invention, the first and second guide units of the guide section form the projecting region in the adhesive tape band path, and adhesive tape band runs as the delivery section is driven. The drive of the delivery section is stopped if, for example, the outermost one (on the lowest-stream side) of the double-coated adhesive tape pieces on the mount of the adhesive tape band is situated in the projecting region. Then, the first drive section is actuated so that the first and second guide units and the guide element relatively move toward one another in the direction across the web path section, and the double-coated adhesive tape piece that is situated in the projecting region is brought entire into contact with the web that stands still in the web path section, whereupon the double-coated adhesive tape piece is stuck to the web. Subsequently, the second drive section is actuated so that the first and second guide units relatively move toward each other along the web path section. As the two guide units move toward each other, the projecting region is shortened in length, so that the portion of the mount of the adhesive tape band having so far been in the projecting region is driven out of the projecting region. Thus, this mount portion moves away from the web path section in the direction across the web path section, so that it is separated from the double-coated adhesive tape piece that is stuck to the web. In sticking one of the double-coated adhesive tape pieces to the web, in this manner, the double-coated adhesive tape piece and the mount can be separated from each other securely and smoothly.

Preferably, according to the present invention, the guide section includes a guide section body movable toward and away from the guide element in the direction across the web path section. The second guide unit is fixed to the guide section body, and the first guide unit is supported on the guide section body for movement relative to the guide section body along the web path section. The first drive section moves the guide section body toward and away from the guide element in the direction across the web path section, and the second drive section moves the first guide unit toward and away from the guide section body along the web path section.

According to this preferred mode, the configurations of individual parts of the sticking device that are associated with the relative movement of the first and second guide units and the relative movement of the two guide units and the guide element and the drive control sequence therefor are simplified.

Further preferably, the guide section includes a first guide roller located on the upstream side of the projecting region in the adhesive tape band path and rotatably supported on the guide section body in a position opposite from the web path section with respect to the projecting region in the direction across the web path section, a base block supported on the guide section body for movement relative to the guide section body along the web path section, and a second guide roller located on the downstream side of the projecting region in the adhesive tape band path and rotatably supported on the base block in a position opposite from the web path section with respect to the projecting region in the direction across the web path section.

According to this preferred mode, the projecting region can be securely formed in the adhesive tape band path, and the travel of the adhesive tape band from the upstream side of the projecting region to the same region and the travel of the adhesive tape band from the projecting region to the downstream side thereof can be carried out smoothly.

Preferably, the plurality of double-coated adhesive tape pieces are stuck to the mount beforehand at spaces from one another in the longitudinal direction of the adhesive tape band.

According to this preferred mode, a plurality of double-coated adhesive tape pieces can be arranged on the mount without providing the sticking device with any cutting section for cutting the continuous double-coated adhesive tape, which are previously stuck to the mount, into the aforesaid plurality of double-coated adhesive tape pieces, so that the construction of the sticking device is simple. Since the given spaces are secured between the double-coated adhesive tape pieces, moreover, one double-coated adhesive tape piece can be securely positioned in the projecting region of the adhesive tape band path, this double-coated adhesive tape piece can be stuck to the web with reliability, and this double-coated adhesive tape piece and the mount can be securely separated from each other.

Preferably, the sticking device of the present invention further comprises a detection unit, located opposite the adhesive tape band path, for outputting a detection signal indicative of the running position of the adhesive tape band in the adhesive tape band path, and an adjusting unit for adjusting the delivery of the adhesive tape band by means of the delivery section in accordance with the detection signal.

According to this preferred mode, the delivery of the adhesive tape band is adjusted in accordance with the running position of the adhesive tape band, so that one double-coated adhesive tape piece can be accurately positioned in the projecting region of the adhesive tape band path.

Further preferably, the plurality of double-coated adhesive tape pieces have a color different from that of the mount. The detection unit includes at least one optical sensor located opposite the adhesive tape band path.

According to this preferred mode, the double-coated adhesive tape pieces have a color different from that of the mount, so that boundary portions between the double-coated adhesive tape pieces and the mount (no-tape-piece portion or mount-exposing portion of the adhesive tape band) can be clearly discriminated in an optical manner. Accordingly, the running position of the adhesive tape band can be optically detected with high accuracy by means of the optical sensor. It is unnecessary, moreover, to provide any special optical position marks between the double-coated adhesive tape pieces, so that the configuration of the adhesive tape band is simple.

Preferably, the sticking device of the present invention further comprises a movement restraining unit for temporarily restraining the movement of the adhesive tape band along the adhesive tape band path.

According to this preferred mode, a substantial tension can be applied to the adhesive tape band by temporarily restraining the movement or travel of the adhesive tape band in sticking the double-coated adhesive tape piece situated in the projecting region of the adhesive tape band to the web and in separating the double-coated adhesive tape piece and the mount from each other, so that sticking of the tape piece to the web and separation of the tape piece and the mount can be carried out securely.

Preferably, the sticking device of the present invention further comprises a brake mechanism including a brake drum rotatable together with a roll of the adhesive tape band and a brake shoe arranged in sliding contact therewith. The movement restraining unit includes a pusher arranged to press the brake shoe and a pusher actuator for pressing the pusher against the brake shoe.

According to this preferred mode, the brake mechanism can apply an appropriate tension to the adhesive tape band running along the adhesive tape band path, and the movement restraining unit can urge the brake mechanism to restrain the movement of the adhesive tape band in sticking the double-coated adhesive tape piece to the web. Thus, the construction of the movement restraining unit can be simplified if the sticking device is provided with the brake mechanism.

Preferably, the sticking device of the present invention further comprises a control section for controlling the drive of the delivery section, the first and second drive sections, and the movement restraining unit.

According to this preferred mode, sticking of the double-coated adhesive tape piece to the web by means of the sticking device can be carried out automatically and securely.

BEST MODE FOR CARRYING OUT THE INVENTION

The following is a description of a wrapping paper feed unit of a cigarette manufacturing machine and a sticking device according to one embodiment of the present invention attached thereto.

Figure 1:
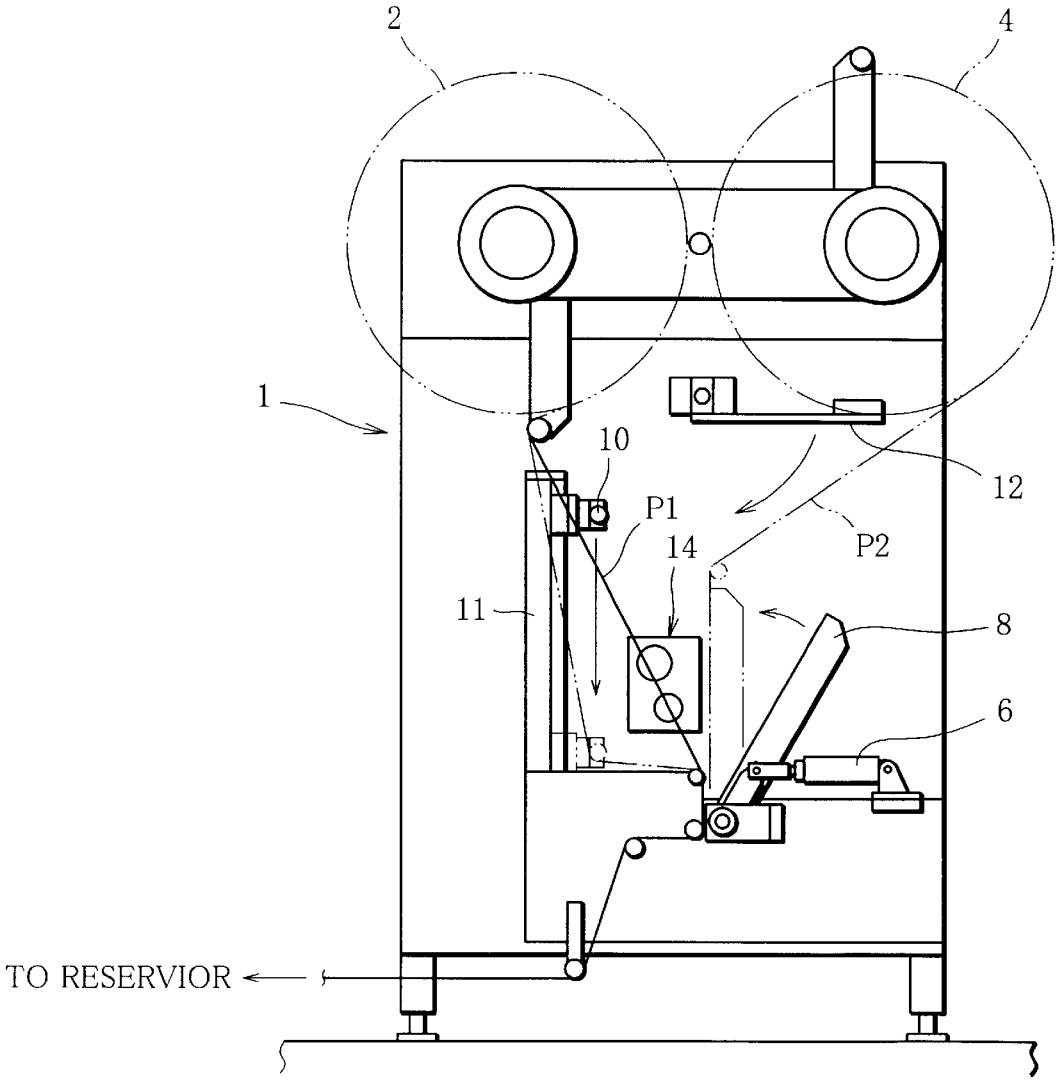
FIG. 1 is a schematic view showing a paper supply unit furnished with a sticking device according to one embodiment of the present invention.

As shown in FIG. 1, a paper supply unit 1 has first and second paper rolls 2 and 4. A first or second paper (more generally, web) P1 or P2 that is delivered from one of the two rolls 2 and 4 is run along a paper path (more generally, web path) that is defined by a large number of guide rollers, and is supplied to a wrapping section of the cigarette manufacturing machine through a reservoir box (not shown). In FIG. 1, the paper path is represented by a full line and a two-dot chain line that are indicative of the papers P1 and P2, respectively.

If the residue of the first paper P1 for the cigarette manufacture is scarce, the paper supply unit 1 performs automatic connecting operation to connect the first and second papers P1 and P2. In carrying out this connecting operation, a cylinder 6 is driven to raise a suction conveyor 8 to a position indicated by two-dot chain line in FIG. 1. Further, an up-and-down roll 10 lowers along a guide rail 11 to change the path of the first paper PI, as indicated by two-dot chain line in FIG. 1, thereby avoiding interference between the first paper P1 and a sticking device 14 that is jutted out from the front face of the paper supply unit 1 to perform operation for sticking a double-coated tape piece to the leading end portion of the second paper P2. Furthermore, a drawer arm 12 draws out the leading end portion of the second paper P2 from the paper roll 4, and then turns around an arm turning shaft, thereby positioning the paper P2 on a suction surface of the suction conveyor 8. Then, the suction conveyor 8 transports the attracted paper P2 further downward, thereby causing the leading end portion of the paper P2 to face the sticking device 14. The suction conveyor 8 serves as a guide element that defines the traveling path of the paper P2. Subsequently, the double-coated adhesive tape piece is stuck to the leading end portion of the paper P2 by means of the sticking device 14, and the leading end portion of the second paper P2 is connected to the trailing end portion of the first paper P1 by means of the double-coated adhesive tape piece.

Since the first paper P1 is connected to the second paper P2 in the same manner as in the aforesaid case, its description is omitted. In the description to follow, the paper P1 or P2 will be referred to as the paper P.

Figure 7:
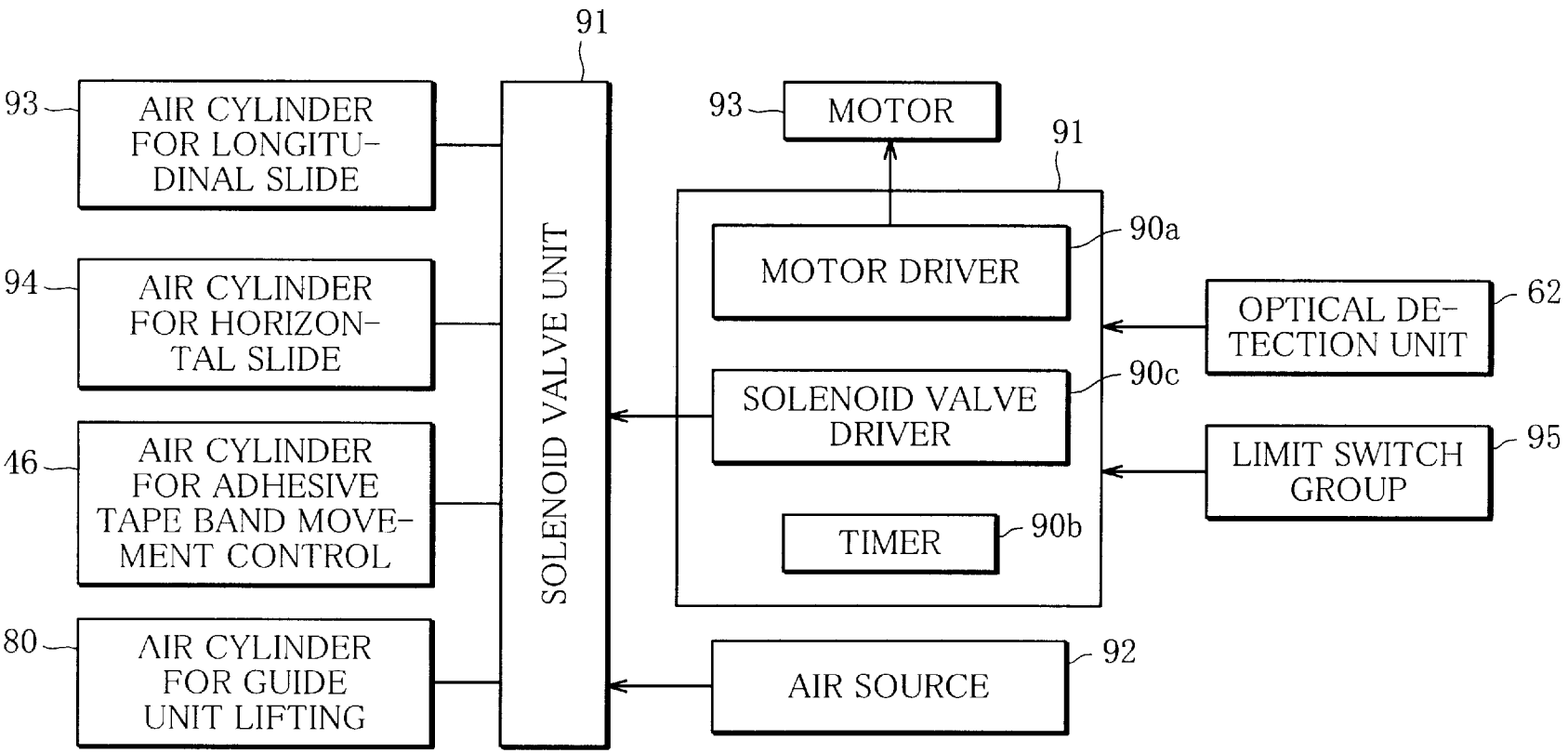
FIG. 7 is a schematic block diagram showing a controller of the sticking device and its peripheral elements.

The sticking device 14 is attached to the front face of the body of the paper supply unit 1. When the double-coated adhesive tape piece is stuck to the paper P, the sticking device is jutted out from the front face of the paper supply unit body as aforesaid and positioned near the paper P that is held on the suction surface of the suction conveyor 8. The sticking device 14 is advanced toward or retreated from the paper supply unit body by means of a conventional longitudinal slide mechanism that includes, for example, a double-acting air cylinder (denoted by numeral 93 in FIG. 7) and a slide rail.

Figure 2:
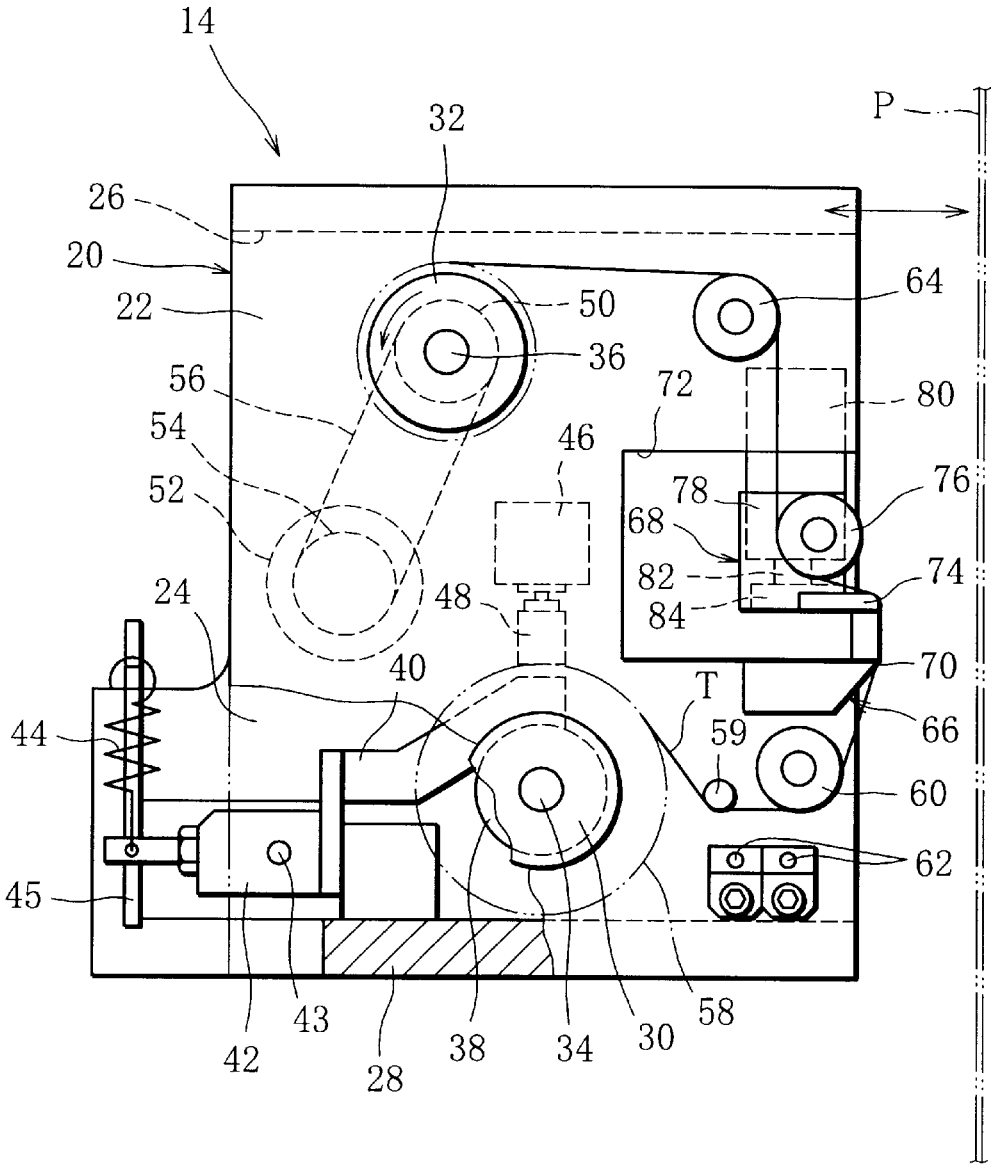
FIG. 2 is a front view showing the sticking device of FIG. 1 in detail.

As shown in FIG. 2, the body of the sticking device 14 is composed of a box frame (hereinafter referred to as body frame 20), in which front and rear wall plates 22 and 24, which are spaced in the depth direction of the paper supply unit 1 and extend parallel to each other, are connected to each other by means of upper and lower plates 26 and 28. In FIG. 2, the front wall plate 22 and the lower plate 28 are broken away.

A holder 30 that is fitted with a roll 58 of an adhesive tape band and a reel 32 for taking up the adhesive tape band are arranged protruding from the front face of the front wall plate 22 of the body frame 20. The holder 30 and the reel 32 are mounted on the outer end portions of shafts 34 and 36, respectively. These shafts 34 and 36 extend through the front wall plate 22 and are rotatably supported on the front wall plate 22 by means of bearings (not shown), individually.

A brake drum 38 is mounted on the inner end portion of the holder shaft 34 that is situated between the front and rear wall plates 22 and 24, and a brake shoe 40 is in sliding contact with the outer peripheral surface of the brake drum 38. The brake shoe 40 is pressed against the outer peripheral surface of the brake drum 38 with a given force of pressure by means of a conventional rocking mechanism that combines an arm 42, pin 43, tension coil spring 44, and adjusting plate 45.

Figure 9:
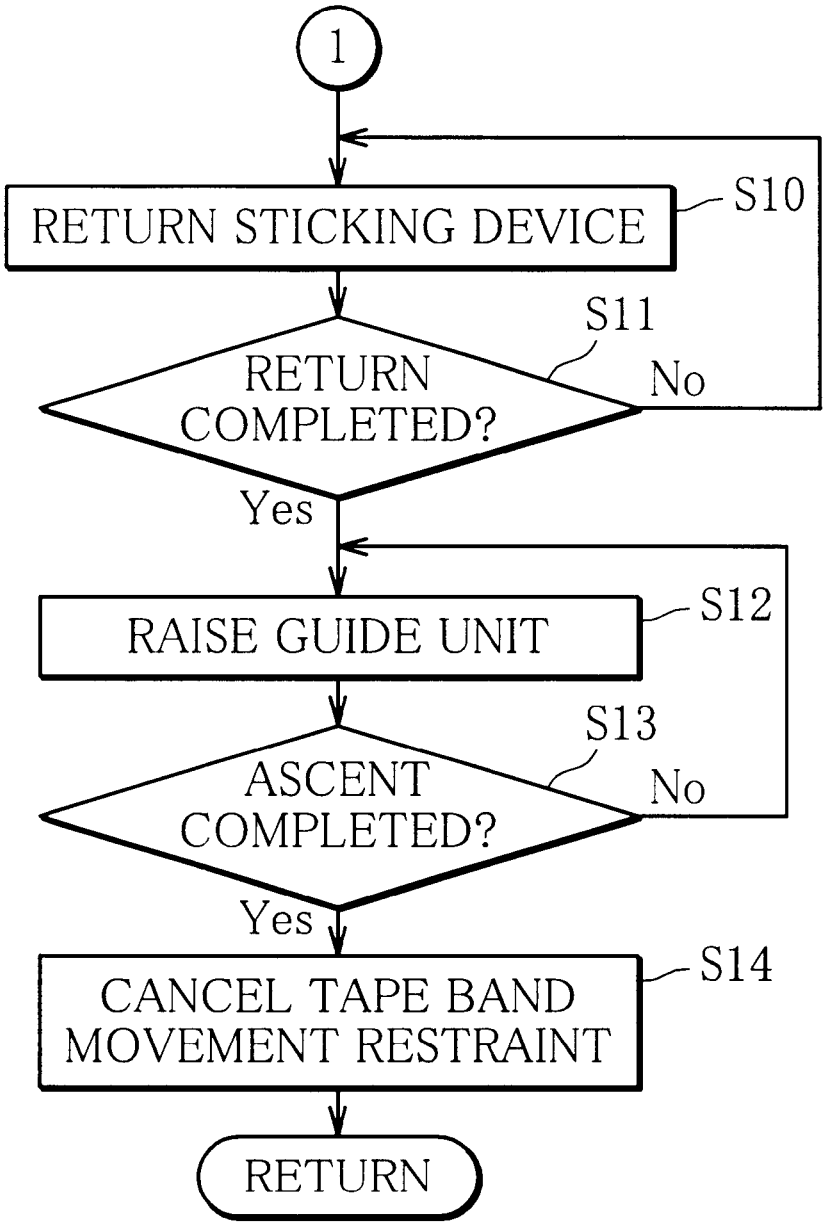
FIG. 9 is a flowchart continued from FIG. 8 and showing the remainder of the control routine.

Over the brake shoe 40, a single-acting air cylinder 46 is located between the front and rear wall plates 22 and 24. A pusher 48 is attached to a piston rod of the air cylinder 46. If a solenoid valve for air supply that corresponds to the air cylinder 46, out of a required number of solenoid valves that constitute a solenoid valve unit 91, is opened under the control of a solenoid valve driver 90*c* (FIG. 9) of a controller 90 of the sticking device, air is supplied from an air source 92 to a cylinder chamber of the air cylinder 46 so that the piston rod of the air cylinder 46 extends, whereupon the pusher 48 engages and presses the brake shoe 40. In the operation for sticking the double-coated adhesive tape to the paper P, for example, therefore, the push force of the brake shoe 40 can be made higher than that of an ordinary one by driving the air cylinder 46 in the aforesaid manner. As this is done, the brake shoe 40 applies a braking force greater than an ordinary one to the brake drum 38, so that the roll 58, which is integral with the brake drum 38, is restrained from rotating, and the adhesive tape band wound on the roll 58 is restrained from moving. Thus, a substantial tension can be applied to an adhesive tape band T (FIG. 3) that is formed of a mount D and a large number of double-coated adhesive tape pieces A thereon, and sticking of each tape piece A to the paper P and separation of the tape piece A and the mount D can be carried out securely.

The pusher 48 and the air cylinder (pusher actuator) 46 constitute a principal part of a movement restraining unit that is actuated temporarily to restrain the movement of the adhesive tape band T under the control of the controller (control section) 90.

A toothed pulley 50 is mounted on the inner end portion of the reel shaft 36. A stepping motor 52 is located between the front and rear wall plates 22 and 24, and a toothed pulley 54 is mounted on an output shaft (not shown) of the motor 52. A toothed belt 56 is passed around and between the toothed pulleys 52 and 54. A one-way clutch, not shown, is inserted in a bearing of the reel shaft 36, whereby the reel 32 is restrained from rotating reversely. When the motor 52 is rotated in this arrangement, the adhesive tape band T is wound up on the reel 32 on the shaft 36.

Figure 3:
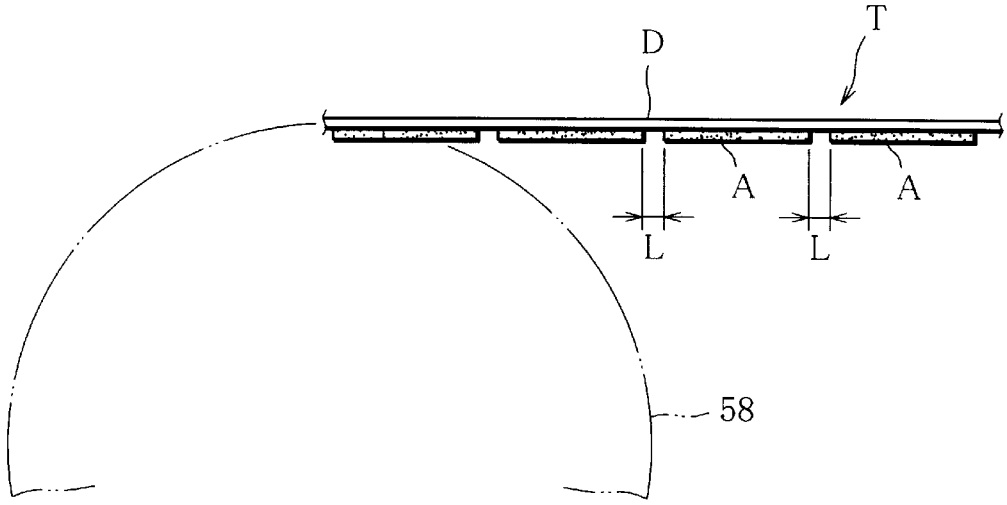
FIG. 3 is a partial enlarged view of an adhesive tape band.

The tape roll 58 is held on the holder 30, as indicated by two-dot chain line in FIG. 2, and the adhesive tape band T is drawn out of the tape roll 58. As shown in FIG. 3 and as mentioned before, the adhesive tape band T is formed of the belt-shaped mount D and the double-coated adhesive tape pieces A that continuously range thereon. One side of each individual tape piece A is stuck to and held on the mount D. Given spaces L (e.g., about 2 mm) are secured between these continuous tape pieces A. The tape pieces A have a color different from that of the mount D. In the tape roll 58, the adhesive tape band T is wound in a manner such that the row of the tape pieces A is located inside the mount D, so that the tape pieces A are never exposed to the outside until the tape band T is drawn out as illustrated.

A guide pin 59 and a lower guide roller (first guide roller) 60 are arranged side by side near the holder 30, and constitute an upstream portion of a tape band path. The guide pin 59 and the lower guide roller 60 are rotatably supported on the front wall plate 22 of the body frame 20. The tape band T drawn out of the tape roll 58 is guided by and extend horizontally between the guide pin 59 and the lower guide roller 60, and is then bent upward along the lower guide roller 60. Between the guide pin 59 and the lower guide roller 60, two optical sensors 62*a* are located under the tape band path so as to adjoin each other along the same path and face a tape piece sticking surface of the tape band. These optical sensors 62*a* constitute a detection unit 62 (FIG. 7) that detects the boundary between each tape piece and the mount from the tape piece sticking surface side and outputs a detection signal that is indicative of the running position of the tape band in the tape path.

An upper guide roller 64 is located near the reel 32. The tape band T is guided from the lower guide roller 60 toward the upper guide roller 64, further guided from the reel 32 via the upper guide roller 64, and taken up by means of the reel 32.

If the aforesaid motor 52 is driven, the reel 32 can be rotated in the take-up direction, whereby the tape band T can be delivered from the tape roll 58. Thus, the motor 52 and the holders 30 and 32 constitute a principal part of a delivery section for delivering the tape band T.

A guide section of the sticking device 14, which serves to define the tape band path, includes the guide pin 59 and the guide rollers 60 and 64 as its principal part. The guide section includes a guide block 66 and a lift guide unit 68 that are arranged between the guide rollers 60 and 64. The guide block 66 and the guide unit 68 define an intermediate portion of the tape band path that faces a path section (more generally, web path section) that forms a part of the paper path. In this paper path section, the double-coated adhesive tape pieces are stuck to the paper P. As illustrated by way of example in FIG. 1, the paper path is defined by a large number of guide rollers that include the up-and-down roller 10. When the paper is connected, the paper path section is defined by the suction surface of the suction conveyor 8.

The sticking device 14 can not only advance toward or retreat from the front face of the paper supply unit 1, as mentioned before, but also move toward or away from the paper P as a whole. More specifically, the body frame 20 of the sticking device 14 can be slid in the horizontal direction with respect to the paper supply unit 1, as indicated by an arrow in FIG. 2, by means of a horizontal slide mechanism that is composed of, for example, a conventional double-acting air cylinder (denoted by numeral 94 in FIG. 7) and a slide rail.

The body frame 20 of the sticking device 14 functions also as a guide section body that supports the aforesaid guide block (second guide unit) 66 and the lift guide unit (first guide unit) 68. The aforesaid horizontal slide mechanism for sliding the body frame 20 with respect to the paper supply unit 1 constitutes a first drive section that relatively moves the guide section body (guide block 66 and guide unit 68) and the suction conveyor 8, which defines the paper path section, toward and away from each other in a direction across the paper path section (preferably, direction perpendicular to the path section).

Instead of using the aforesaid horizontal slide mechanism, an assembly that includes the cylinder 6 and the suction conveyor 8 may be designed for horizontal movement with respect to the body frame 20 so that the paper on the suction conveyor (guide element) 8 and in the paper path section can be horizontally moved with respect to the guide section body.

In the present embodiment, the guide block 66 is fixed to the front wall plate 22 of the body frame 20, and the lift guide unit 68 is supported for movement with respect to the guide block 66 by means of the front wall plate (guide section body) 22.

As shown in FIG. 2, the front wall plate 22 is provided with rectangular notch 72 on the side of the paper P in an intermediate position with respect to the height direction of the plate, and the lift guide unit 68 is located in the notch 72. The lift guide unit 68 includes a base block 78, which is supported for up-and-down motion on the front wall plate 22 by means of a guide rail (not shown) on the front wall plate 22, for example, and a guide plate 74 and a guide roller (second guide roller) 76 mounted on the base block 78.

The rear wall plate 24 is provided with a double-acting air cylinder 80 situated behind the lift guide unit 68, and a piston rod 82 of the air cylinder 80 and the aforesaid base block 78 are connected to each other by means of a connecting plate 84. As the piston rod 82 extends or contracts, therefore, the lift guide unit 68 can descend or ascend for the stroke of extension or contraction in the notch 72. Further, a speed control mechanism is incorporated in the air cylinder 80. The air cylinder 80 and the base block 78 constitute a principal part of a second drive section that causes the guide block 66 and the lift guide unit 68 relatively to move toward and away from each other along the paper path section.

The guide block 66 has, on it outer end, an edge 70 that protrudes form the paper-side end face of the body frame 20 toward the paper P. The edge 70 is situated in a position that projects from the paper-side end face of the body frame (guide section body) 20 toward the paper P, as viewed in the horizontal direction of the sticking device 14, so that it is located in a paper-side horizontal position with respect to the lower guide roller 60. The guide plate 74 of the lift guide unit 68 is located so that its distal end is situated in the same horizontal position as that of the edge 70, and the guide roller 76 of the lift guide unit 68 is situated in a horizontal position a little nearer to the paper than the lower guide roller 60 is.

The edge 70 of the guide block 66 and the guide plate 74 of the lift guide unit 68 both have a given width corresponding to the width of the tape band T, and can guide the tape band T from the side of the mount D.

In the tape band path, the tape band T extends diagonally upward from the lower guide roller 60 to the edge 70 located on the downstream side of the roller 60, and is located horizontally outside the paper-side end face of the body frame 20 at the edge 70. Then, the tape band T extends vertically upward from the edge 70 to the distal end of the guide plate 74 without substantially changing horizontal position. At the distal end of the guide plate 74, the tape band T is sharply bent horizontally inward to be directed to the guide roller 76. Thus, the tape band T projects toward the paper P in a region between the edge 70 of the guide block 66 and the distal end of the guide plate 74 of the lift guide unit 68. In other words, the guide block (second guide unit) 66 and the lift guide unit (first guide unit) 68 form, in the tape band path, a projecting region that projects toward the aforesaid paper path section in a direction across the path section and extends along the path section. Preferably, the projecting region projects in a direction perpendicular to the paper path section and extends parallel to the tape piece sticking surface of that paper portion which is located in the paper path section. The two guide units 66 and 68 can relatively move toward and away from each other along the paper path section, so that the length of the projecting region of the tape band path is variable, and one double-coated adhesive tape piece can be positioned in this projecting region.

The following is a description of the tape piece sticking operation of the sticking device 14.

The tape roll 58 is wound with the tape band T that has a lead portion with a given length at its foremost end portion to which no tape piece A is stuck. If necessary, the tape band T is drawn out of the tape roll 58 and its lead portion is anchored to the reel 32 before the operation of the sticking device 14 is started.

The sticking device 14 is operated with the tape band T set up in this manner. During the operation of the sticking device 14, the controller 90 carries out the control illustrated in the flowcharts of FIGS. 8 and 9, thereby controlling the drive of various operating sections of the sticking device 14.

When the motor 52 is driven, the tape band T is taken up by means of the reel 32, so that the tape band T is delivered from the tape roll 58. As this is done, a given resistance is applied to the rotation of the holder 30 by means of the force of friction between the brake shoe 40 and the brake drum 38, so that a suitable tension is generated in the delivered tape band T.

Figure 8:
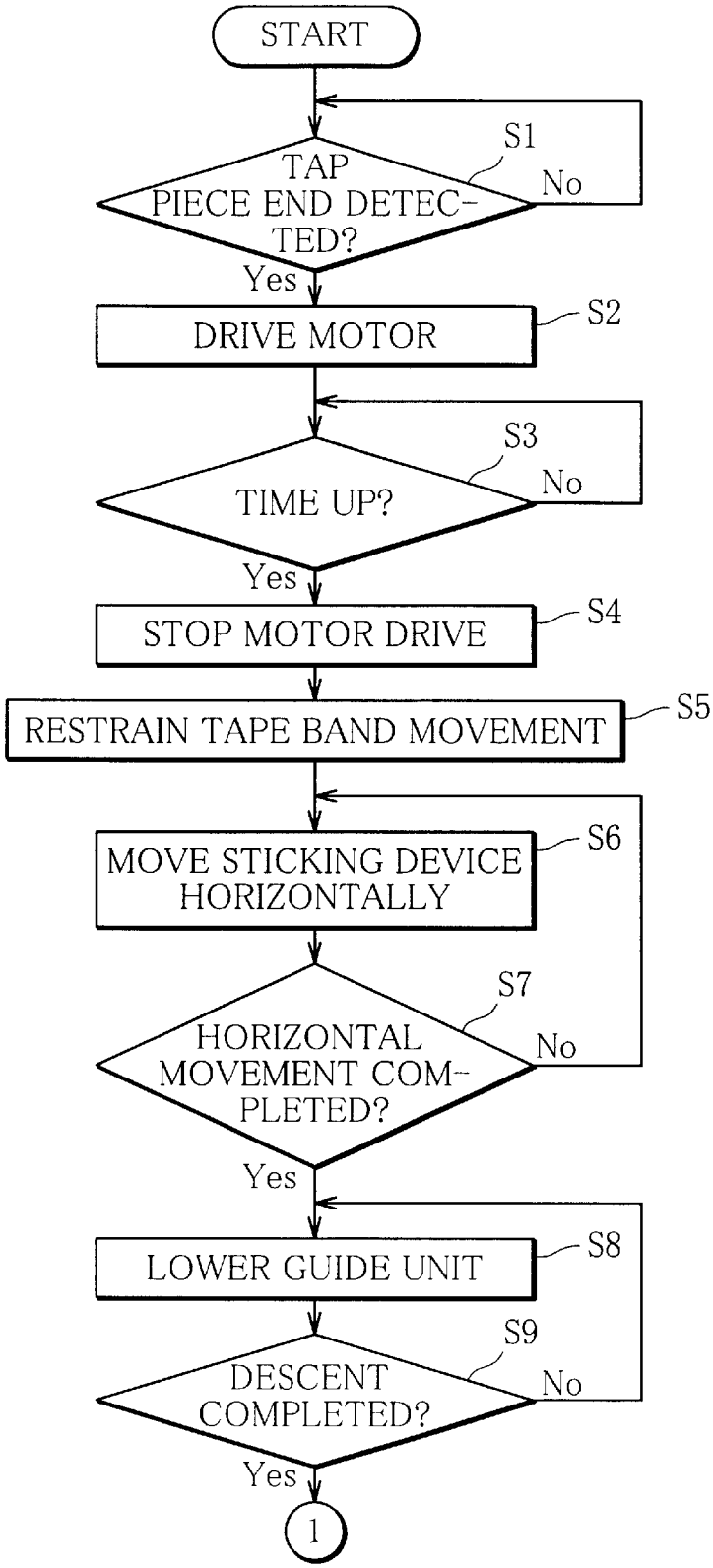
FIG. 8 is a flowchart showing a part of a control routine carried out by means of the controller.

While the tape band T is being delivered, whether or not the leading end of the outermost one of the tape pieces A that are stuck to the mount D of the tape band T has reached the optical sensor 62*a* on the upstream side with respect to the tape band path is determined in accordance with the respective outputs of the two optical sensors 62*a* (Step S1 of FIG. 8). Let it be supposed, for example, that the output from the optical sensor 62*a* on the upstream side is on a first level corresponding to the mount D and that the output from the optical sensor 62*a* on the downstream side is changed from the first level to a second level corresponding to the tape piece A. Thereupon, the arrival of the tape piece A is detected. Since the tape piece A has a color different from that of the mount D, the tape piece A can be suitably detected by means of the optical sensors 62*a*.

The controller 90 of the sticking device 14 contains therein a motor driver 90*a* for controlling the rotational angle of the motor 52 and a timer 90*b*. Based on detection signals from the two optical sensors 62*a*, the controller rotates the motor 52 during the time interval that elapses from the instant that the distal end of the tape piece A is detected until a given time preset in the timer 90*b* is over (Step S3), and stops the rotation of the motor 52 when the given time is over (Step S4). This given time is set to be equal to a period of time that is normally required for the tape piece A to be accurately situated in the projecting region of the tape band path, which region is defined by the edge 70 of the guide block 66 and the distal end of the guide plate 74, as the tape band T is delivered after the tape piece A is detected by means of the optical sensors 62*a*. The controller 90 functions as an adjusting unit for adjusting the delivery of the tape band T.

Figure 5:
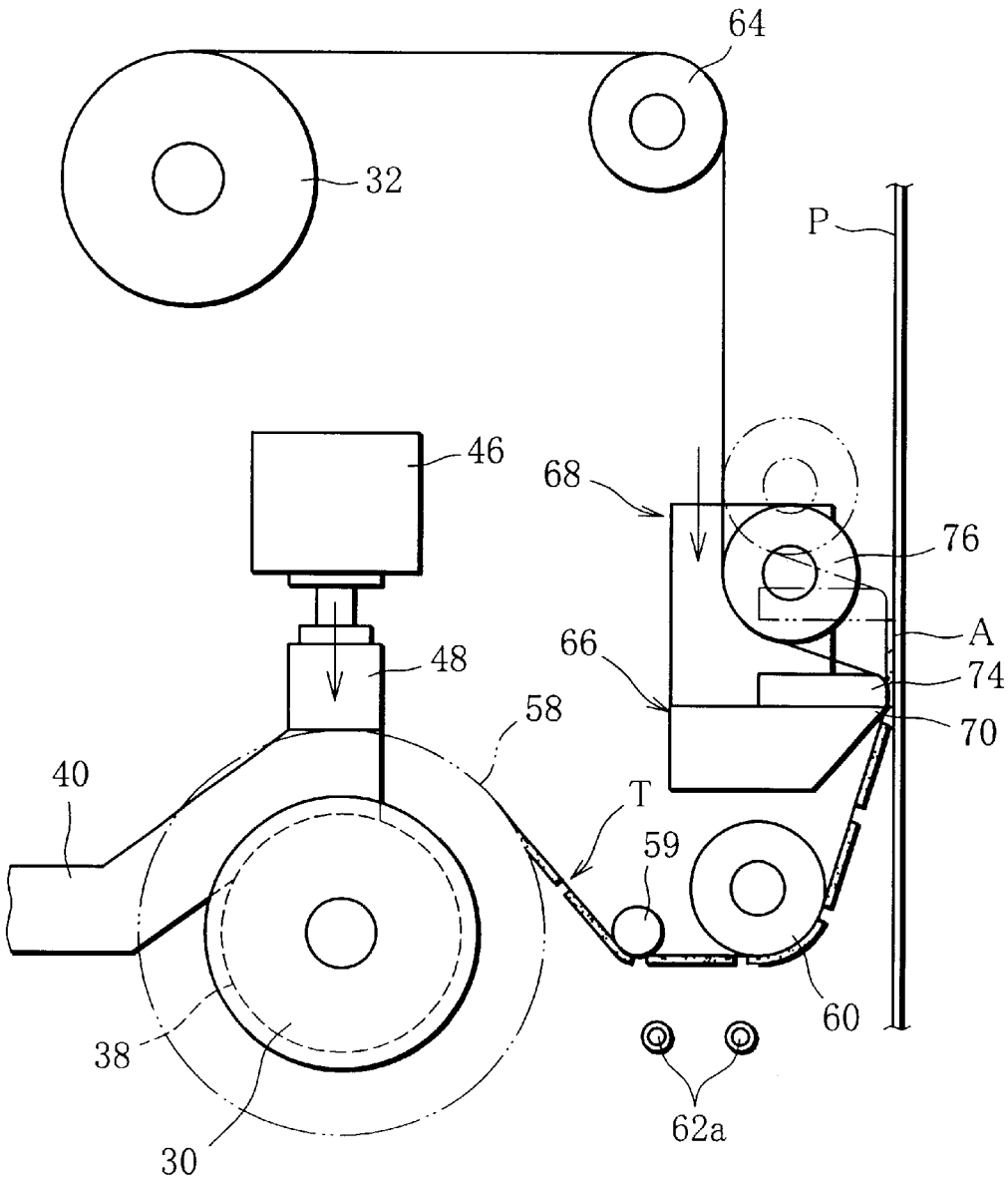
FIG. 5 is a schematic view showing descending action of a lift guide unit of the sticking device.

If the tape piece A is situated in the projecting region between the edge 70 and the distal end of the guide plate 74 in this manner, the solenoid valve for air supply that corresponds to the air cylinder 46 opens so that the air cylinder 46 is driven in the manner indicated by an arrow in FIG. 5, whereupon the pusher 48 attached to its piston rod urges the brake shoe 40 further to press the brake drum 38, and free rotation of the holder 30 that is fitted with the tape roll 58 is restricted. Furthermore, the rotation of the reel 32 in the direction opposite to the take-up direction is restrained by means of the one-way clutch. Accordingly, the tape band T on the tape band path is restrained from moving in the delivery direction and from moving in the rewinding direction. Thus, the movement of the tape band T is inhibited or prohibited (Step S5).

Then, a solenoid valve for a forward stroke that corresponds to the air cylinder 94 of the horizontal slide mechanism opens, and air is supplied to a forward-stroke cylinder chamber of the air cylinder 94, whereupon the whole sticking device 14 is horizontally moved toward the paper P (Step S6). If a corresponding one of limit switches that constitute a limit switch group 95 is turned on so that the arrival of the sticking device 14 at a target horizontal moved position is detected (Step S7), for example, the air supply to the air cylinder 94 is stopped, whereupon the sticking device 14 comes to a standstill in this horizontal movement completion position.

Figure 4:
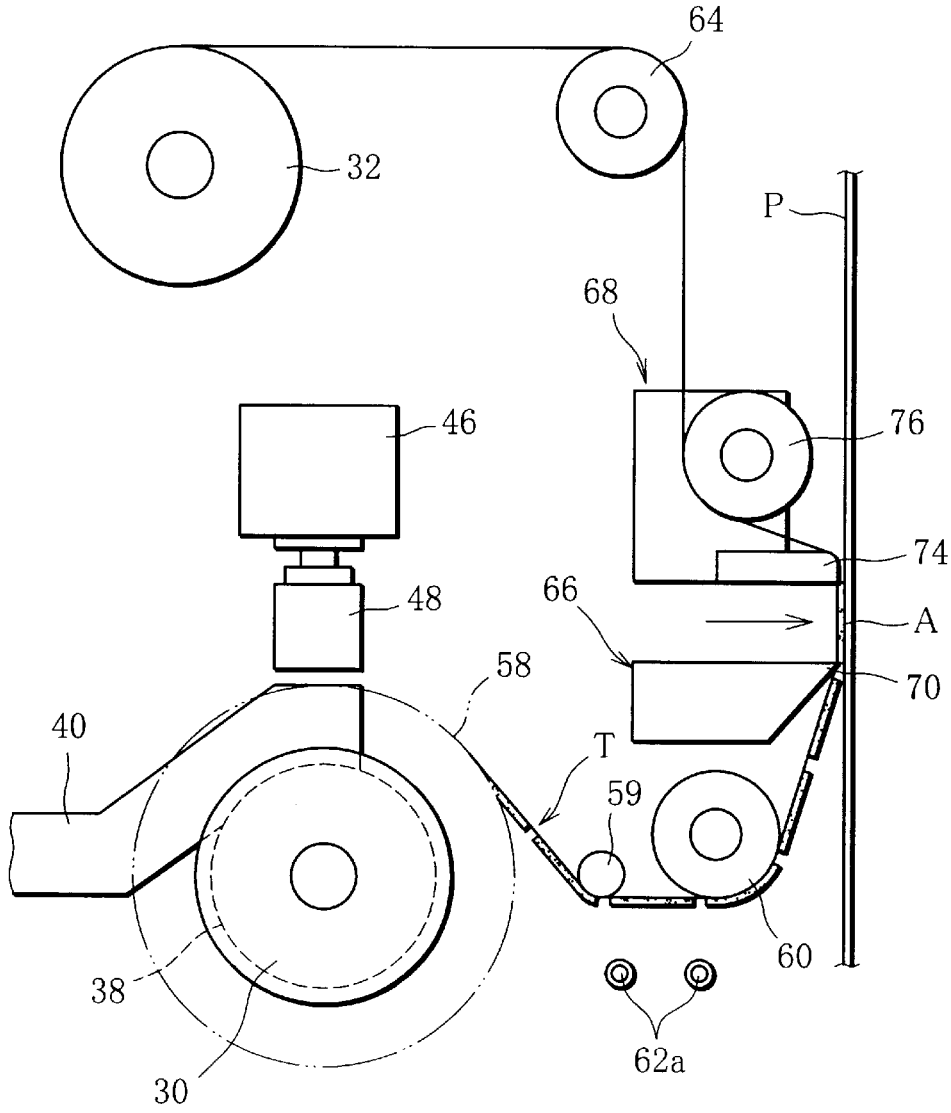
FIG. 4 is a schematic view showing double-coated adhesive tape piece sticking operation of the sticking device.

As this is done, the tape piece A that is situated in the projecting region between the edge 70 and the distal end of the guide plate 74 is pressed entire against the paper P that is held on the suction surface of the suction conveyor 8, which defines the paper path section, as shown in FIG. 4, whereupon the tape piece A is stuck to the paper P. At this point of time, the movement of the tape band T along the tape band path is restricted, so that the path length for the tape band T that ranges from the lower guide roller 60 to the upper guide roller 64 never changes substantially. Therefore, the possibility of the tape piece A being stuck to a position deviated with respect to the paper P can be eliminated or lowered.

Then, a solenoid valve for a descending stroke that corresponds to the air cylinder 80 is driven so that the piston rod 82 extends as air is supplied to a descending-stroke cylinder chamber of the air cylinder 80, and the lift guide unit 68 moves toward the guide block 66 or descends, as indicated by an arrow in FIG. 5 (Step S8).

Figure 6:
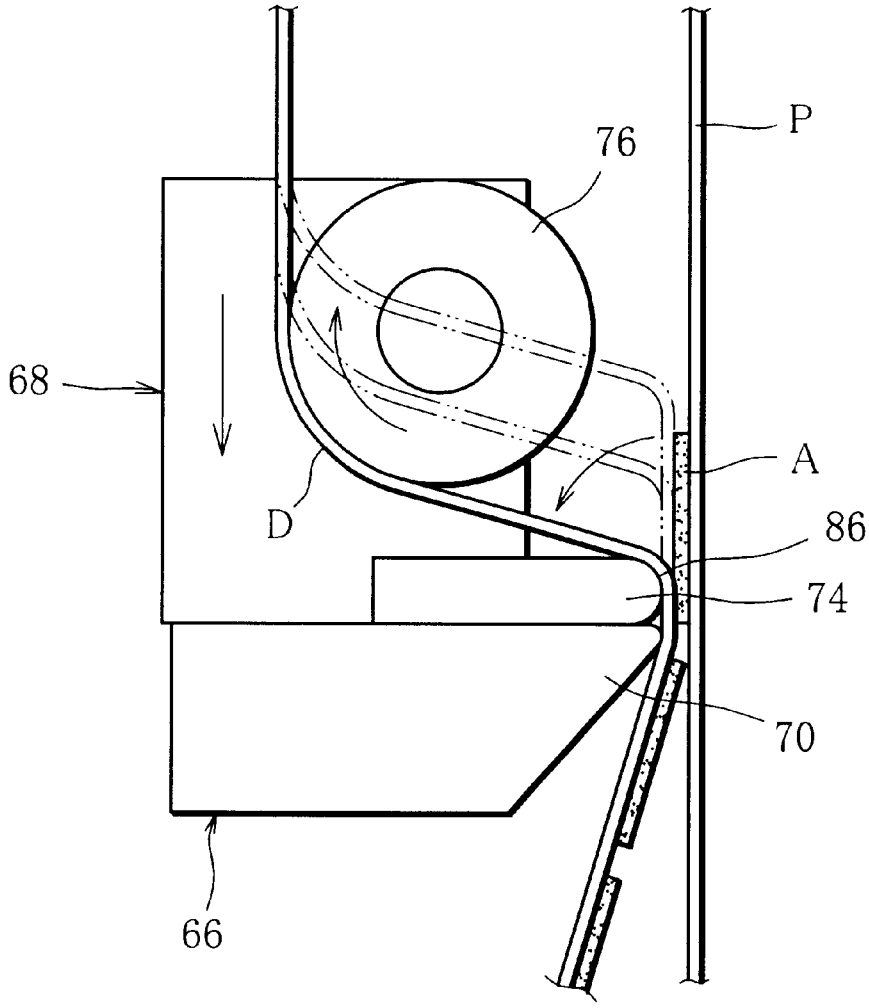
FIG. 6 is a partial enlarged view showing the way a tape piece and a mount are separated from each other as the lift guide unit descends.

As the lift guide unit 68 descends, as shown in FIG. 6, the length of the projecting region between the edge 70 and the distal end of the guide plate 74 is gradually reduced, so that the mount D of the tape band T is gradually separated from the tape piece A that is stuck to the paper P.

The tape band path is designed so that the mount D can be substantially bent on a guide surface 86 that is formed on the distal end of the guide plate 74. The guide surface 86 is formed in the shape of a smooth circular arc, as shown in FIG. 6, and the guide plate 74 is formed of a material that shares a low coefficient of friction with the mount D. While the lift guide unit 68 is descending, the movement of the tape band T along the tape band path is still restricted, and the tape band path length between the guide rollers 60 and 64 never changes. Accordingly, the bent region of the mount D on the guide surface 86 moves smoothly to the upstream side (lower side) of the tape band as the lift guide unit 68 descends. Besides, the movement of the bent region of the mount D is equal to the descent of the lift guide unit 68. As the lift guide unit 68 descends, that is, as the guide plate 74 having the guide surface 86 that bends the mount D descends, therefore, the mount D can be separated smoothly from the tape piece A.

The lift guide unit 68 is constructed so that it can ascend and descend parallel to the mount D that extends between the guide roller 76 and the upper guide roller 64. While the lift guide unit 68 is descending, therefore, the state of pressure contact between the guide surface 86 of the guide plate 74 and the tape band T that is attained by the horizontal movement of the sticking device 14 in Steps S6 and S7 can be maintained. Thus, while the mount D is being separated from the tape piece A that is stuck to the paper P as the lift guide unit 68 descends, the tape piece A is pressed toward the paper P through the mount D by means of the guide surface 86 of the guide plate 74, so that the possibility of the tape piece A being separated from the paper P can be eliminated or lowered.

In order to prevent the tape piece A more securely from being separated from the paper P during the separation of the mount D from the tape piece A, moreover, the sticking device 14 may be further moved toward the paper P from the completion position for the horizontal movement of the sticking device 14 in Steps S6 and S7 during the time interval between the start and completion of the descent of the lift guide unit 68 so that the force of the guide plate 74 to push the tape band T toward the paper P can be increased further.

If a corresponding one of the limit switches in the group 95 is turned on so that the completion of the descent of the lift guide unit 68, that is, the completion of the mount separation, is detected (Step S9), thereafter, the solenoid valve for the descending stroke is turned off to stop the air supply to the descending-stroke cylinder chamber of the air cylinder 80, and the lift guide unit 68 is held in a descent completion position. Further, the solenoid valve for the forward stroke that corresponds to the air cylinder 94 of the horizontal slide mechanism closes, a solenoid valve for a backward stroke opens, and air is supplied to a backward-stroke cylinder chamber of the air cylinder 94, whereupon the whole sticking device 14 is horizontally moved away from the paper P (Step S10), and only the stuck tape piece A is left on the paper P on the suction conveyor 8.

When the sticking device 14 is returned to its standby position of FIG. 1 (Step S11), the solenoid valve for the backward stroke that corresponds to air cylinder 94 closes so that the horizontal movement of the sticking device 14 in the returning direction is completed. Further, a solenoid valve for an ascending stroke that corresponds to the lift guide unit 68 is turned on so that air is supplied to an ascending-stroke cylinder chamber of the air cylinder 80, whereupon the lift guide unit 68 ascends (Step S12). If the completion of the ascent is detected by means of the limit switches (Step S13), the air supply is stopped, and the lift guide unit 68 is held in its standby position. Furthermore, the solenoid valve for air supply that corresponds to the air cylinder 46 is turned off, and a solenoid valve for air discharge is turned on, whereupon air in the cylinder chamber of the air cylinder 46 is discharged, and the piston rod is returned by means of the spring force of a return spring in the air cylinder. As this is done, application of braking force to the brake drum 38 by means of the pusher 48, that is, restraint of the movement of the tape band, can be canceled (Step S13). In consequence, the sticking device 14 is restored to its initial state and stands ready for the next automatic connecting operation of the paper supply unit 1.

According to the sticking device 14 of the embodiment described above, the mount D can be securely separated simultaneously with the operation for sticking the tape piece A, so that it is considerably conducive to the smooth advance of the automatic connecting operation for the paper P by means of the paper supply unit 1.

If the given spaces L are previously secured between the successive tape pieces A on the tape band T, as in the case of this embodiment, moreover, the sticking device 14 can more securely stick the tape pieces A and separate the mount D. Since the tape pieces A are colored, furthermore, the detection of the tape pieces A by means of the optical sensors 62*a* is easy, and the accuracy of delivery of the tape band T and the positioning accuracy for the tape pieces A are improved.

Further, the normal braking force can be set at a low level by increasing the braking force of the holder 30 by means of the air cylinder 46 so that the tape band T can be satisfactorily delivered by means of the motor 52. In separating the mount D, furthermore, the braking force is increased, and the tape band T is restrained from running freely, so that the separating operation can be carried out securely.

The present invention is not limited to the embodiment described above, and the specific configurations of individual parts can be changed variously. Although the guide block 66 and the guide plate 74 in the foregoing embodiment are configured as members that are in sliding contact with the tape band T, one or both of them may be replaced with a roller or pin.

Further, the lift guide unit 68 may be provided integrally with a take-up reel so that the reel can be rotated to take up the mount D in synchronism with the descent of the lift guide unit 68. If the lift guide unit 68 is then raised, in this case, the tape band T can be delivered without rotating the reel.

Furthermore, the web to which the tape pieces A are to be stuck is not limited to a cigarette paper or tip paper.

What is claimed is:

1. In an adhesive tape piece sticking device that sticks a double-coated adhesive tape piece to a web in a web path section defined by a guide element and constituting a part of a web path, the adhesive tape piece sticking device comprising:

a delivery section for delivering an adhesive tape band composed of a mount and a plurality of double-coated adhesive tape pieces provided thereon;

a guide section including first and second guide units arranged for relative movement toward and away from each other along the web path section and for relative movement relative to said guide element in a direction across the web path section, said first and second guide units serving to guide the adhesive tape band from a mount side thereof and form a projecting region with a variable region length in an adhesive tape band path, said projecting region projecting toward the web path section in the direction across the web path section, extending along the web path section, and permitting one of the double-coated adhesive tape pieces to be positioned in said projecting region;

a first drive section for relatively moving said first and second guide units and said web path section toward and away from one another in a direction across the web path section; and a second drive section for relatively moving said first and second guide units toward and away from each other along the web path section.

2. An adhesive tape piece sticking device according to claim 1, wherein:

said guide section includes a guide section body movable toward and away from the web path section in the direction across the web path section, said second guide unit is fixed to said guide section body, said first guide unit is supported on said guide section body for movement relative to said guide section body along the web path section, said first drive section moves said guide section body toward and away from said guide section body in the direction across the web path section, and said second drive section moves said first guide unit toward and away from said guide section body along the web path section.

3. An adhesive tape piece sticking device according to claim 2, wherein said guide section includes a first guide roller located on an upstream side of said projecting region in the adhesive tape band path and rotatably supported on said guide section body in a position opposite from the web path section with respect to said projecting region in the direction across the web path section, a base block supported on said guide section body for movement relative to said guide section body along the web path section, and a second guide roller located on a downstream side of said projecting region in the adhesive tape band path and rotatably supported on said base block in a position opposite from the web path section with respect to said projecting region in the direction across the web path section.

4. An adhesive tape piece sticking device according to claim 1, wherein said plurality of double-coated adhesive tape pieces are stuck to said mount beforehand at spaces from one another in a longitudinal direction of said adhesive tape band.

5. An adhesive tape piece sticking device according to claim 1, which further comprises:

a detection unit, located opposite the adhesive tape band path, for outputting a detection signal indicative of a running position of said adhesive tape band in the adhesive tape band path, and an adjusting unit for adjusting delivery of said adhesive tape band by means of said delivery section in accordance with said detection signal.

6. An adhesive tape piece sticking device according to claim 5, wherein said plurality of double-coated adhesive tape pieces have a color different from that of said mount, and said detection unit includes at least one optical sensor located opposite the adhesive tape band path.

7. An adhesive tape piece sticking device according to claim 1, which further comprises a movement restraining unit for temporarily restraining the movement of said adhesive tape band along the adhesive tape band path.

8. An adhesive tape piece sticking device according to claim 7, which further comprises a brake mechanism including a brake drum rotatable together with a roll of said adhesive tape band and a brake shoe arranged in sliding contact therewith, and wherein said movement restraining unit includes a pusher arranged to press said brake shoe and a pusher actuator for pressing the pusher against said brake shoe.

9. An adhesive tape piece sticking device according to claim 7, which further comprises a control section for controlling the drive of said delivery section, said first and second drive sections, and said movement restraining unit.

* * * * *